US009521876B2

(12) United States Patent
Jones et al.

(10) Patent No.: US 9,521,876 B2
(45) Date of Patent: Dec. 20, 2016

(54) ARTICLES OF FOOTWEAR HAVING A SIMILAR APPEARANCE AND DIFFERENT SOLE ASSEMBLIES

(71) Applicant: NIKE, Inc., Beaverton, OR (US)

(72) Inventors: David P. Jones, Beaverton, OR (US); Elizabeth Langvin, Sherwood, OR (US); James Molyneux, Portland, OR (US); Brian Stewart, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 318 days.

(21) Appl. No.: 14/248,414

(22) Filed: Apr. 9, 2014

(65) Prior Publication Data

US 2015/0289585 A1 Oct. 15, 2015

(51) Int. Cl.
*A43B 3/24* (2006.01)
*A43B 13/16* (2006.01)
*A43B 13/28* (2006.01)

(52) U.S. Cl.
CPC ..... *A43B 13/16* (2013.01); *A43B 3/246* (2013.01); *A43B 13/28* (2013.01)

(58) Field of Classification Search
CPC ..... A43B 13/16; A43B 13/28; A43B 13/18; A43B 13/383; A43B 13/386; A43B 3/246
USPC ..... 36/100, 101, 102, 103
See application file for complete search history.

(56) References Cited

U.S. PATENT DOCUMENTS 3,878,626 A * 4/1975 Isman ..... A43B 1/0054 36/15
4,733,483 A 3/1988 Lin
4,742,625 A * 5/1988 Sydor ..... A43B 17/18 36/11.5
5,896,677 A 4/1999 Barsorian
6,023,857 A 2/2000 Vizy et al.
6,092,311 A * 7/2000 MacNamara ..... A43B 1/0036 36/100
6,701,643 B2 * 3/2004 Geer ..... A43B 1/0081 36/102
6,920,707 B1 7/2005 Greene et al.
6,948,263 B2 9/2005 Covatch
7,010,872 B2 * 3/2006 Pawlus ..... A43B 3/0047 36/100
7,055,265 B1 * 6/2006 Bathum ..... A43B 5/08 36/11.5

(Continued)

FOREIGN PATENT DOCUMENTS

DE 92 07 287 U1 7/1992
DE 296 11 137 U1 8/1996

(Continued)

OTHER PUBLICATIONS

International Search Report and Written Opinion mailed Apr. 16, 2015 in International Application No. PCT/US2015/011169.

(Continued)

*Primary Examiner* — Jila M Mohandesi
(74) *Attorney, Agent, or Firm* — Banner & Witcoff, Ltd.

(57) ABSTRACT

A first and second pair of articles of footwear which may have substantially similar exterior appearances, but the internal structures are different. The first pair of articles may include a traditional sole assembly having an outsole, a midsole, and an insole. The second pair of articles of footwear may include a fixed sole structure allowing for a customizable removable sole insert.

20 Claims, 14 Drawing Sheets

(56) References Cited

U.S. PATENT DOCUMENTS

| | | | | |
|---|---|---|---|---|
| 7,334,350 | B2 | 2/2008 | Ellis, III | |
| 7,392,604 | B2 | 7/2008 | Greene et al. | |
| 7,578,076 | B2 | 8/2009 | Pawlus et al. | |
| 7,600,332 | B2 | 10/2009 | Lafortune | |
| 7,900,379 | B2 * | 3/2011 | Lafortune | A43B 7/142 36/100 |
| 7,908,772 | B2 | 3/2011 | Celia | |
| 8,205,357 | B2 | 6/2012 | Keating et al. | |
| 8,225,532 | B2 * | 7/2012 | Chen | A43B 1/0009 36/103 |
| 8,359,773 | B2 * | 1/2013 | Dal Bello | A43B 3/26 36/117.3 |
| 8,406,454 | B2 | 3/2013 | Bar | |
| 8,640,362 | B2 | 2/2014 | Lafortune | |
| 2006/0053656 | A1 | 3/2006 | Kumle | |
| 2006/0130364 | A1 * | 6/2006 | Greene | A43B 3/24 36/28 |
| 2007/0022630 | A1 | 2/2007 | Lundy, Jr. et al. | |
| 2007/0023955 | A1 | 2/2007 | Ho | |
| 2007/0204484 | A1 | 9/2007 | Davis | |
| 2008/0172904 | A1 | 7/2008 | Pelsue et al. | |
| 2010/0122473 | A1 * | 5/2010 | Santos | A43B 13/36 36/100 |
| 2011/0138659 | A1 | 6/2011 | Park | |
| 2012/0233890 | A1 | 9/2012 | Masters | |

FOREIGN PATENT DOCUMENTS

| | | | |
|---|---|---|---|
| DE | 103 26 600 | A1 | 1/2005 |
| FR | 2 573 633 | A1 | 5/1986 |
| GB | 1 328 765 | A | 9/1973 |
| WO | 85/04786 | A1 | 11/1985 |
| WO | 01/82732 | A1 | 11/2001 |
| WO | 2007/017594 | A1 | 2/2007 |

OTHER PUBLICATIONS

International Search Report and Written Opinion mailed Apr. 2, 2015 in PCT/US2015/011093.

* cited by examiner

ARTICLES OF FOOTWEAR HAVING A SIMILAR APPEARANCE AND DIFFERENT SOLE ASSEMBLIES

CROSS-REFERENCE TO RELATED APPLICATION

This application is related to U.S. Patent Publication Number 2015/0289590, currently U.S. patent application Ser. No. 14/248,431, filed on Apr. 9, 2016, and entitled "Footwear System with Removable Inserts", which application is hereby incorporated by reference in its entirety.

BACKGROUND

The present embodiments relate generally to articles of footwear, and in particular to articles of footwear with different sole assemblies.

Articles of footwear generally include an upper and a sole assembly. The upper may be formed from a variety of materials that are stitched (sewn) or adhesively bonded together to form a space or void within the footwear in order to support and secure a foot. The sole assembly is secured to a lower portion of the upper and is generally positioned between the foot and the ground. In many articles of footwear, including athletic footwear styles, the sole assembly often incorporates an insole, a midsole, and an outsole.

SUMMARY

In one aspect, a plurality of articles of footwear having a first article of footwear having a first upper and a first sole assembly. The first sole assembly has a first sole exterior appearance. The plurality of articles of footwear also has a second article of footwear having a second upper and a second sole assembly. The second sole assembly has a second sole exterior appearance. The first article of footwear and the second article of footwear have substantially identical footwear sizes. Further, the first sole exterior appearance of the first sole assembly is substantially identical to the second sole exterior appearance of the second sole assembly. However, the first sole assembly is different from the second sole assembly.

In another aspect, a plurality of articles of footwear has a first article of footwear having a first exterior appearance, and a second article of footwear having a second exterior appearance. The first article of footwear and the second article of footwear have substantially identical footwear sizes. The first exterior appearance of the first article of footwear is substantially identical to the second exterior appearance of the second article of footwear. A first sole assembly of the first article of footwear is different from a second sole assembly of the second article of footwear.

In another aspect, a plurality of articles of footwear has a first article of footwear having a first upper and a first sole assembly. The first sole assembly has a first sole exterior appearance. The plurality of articles of footwear also includes a second article of footwear having a second upper and a second sole assembly. The second sole assembly has a second sole exterior appearance. The second sole assembly is comprised of a fixed sole structure and a removable sole unit. The first article of footwear and the second article of footwear have substantially identical footwear sizes. The first sole exterior appearance of the first sole assembly is substantially identical to the second sole exterior appearance of the second article of footwear. The second article of footwear further has a first configuration without the removable sole unit. The second article of footwear also has a second configuration where the removable sole unit is inserted in the second article of footwear. The first article of footwear has a first internal cavity with a first interior volume. The second article of footwear has a second internal cavity. The second internal cavity has a second interior volume when the second article of footwear is in the first configuration. The second internal cavity also has a third interior volume when the second article of footwear is in the second configuration. The first interior volume and the third interior volume are more similar than the first interior volume and the second interior volume.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

An article of footwear and a "complementary" article of footwear refer to a matching pair of articles of footwear, substantially similar in materials, design, size, color scheme, logos, fastening system, etc., and wherein a one of the matching pair of articles of footwear is intended to fit on and conform to one of two feet on a person and the other of the matching pair of articles of footwear is intended to fit on and conform to the person's remaining foot. For example, if an article of footwear fits on and configures to a person's left foot, then the complementary article fits on and configures to the right foot. A complementary article is a "mirror image" of an article.

Articles of footwear, also referred to simply as articles, are generally made to fit various sizes of feet. In the embodiments shown, the various articles are configured with the same footwear size. In different embodiments, the articles could be configured with any footwear sizes, including any conventional sizes for footwear known in the art. In some embodiments, an article of footwear may be designed to fit the feet of a child. In other embodiments, an article of footwear may be designed to fit an adult. Still, in other embodiments, an article of footwear may be designed to fit a man or a woman.

Figure 1:
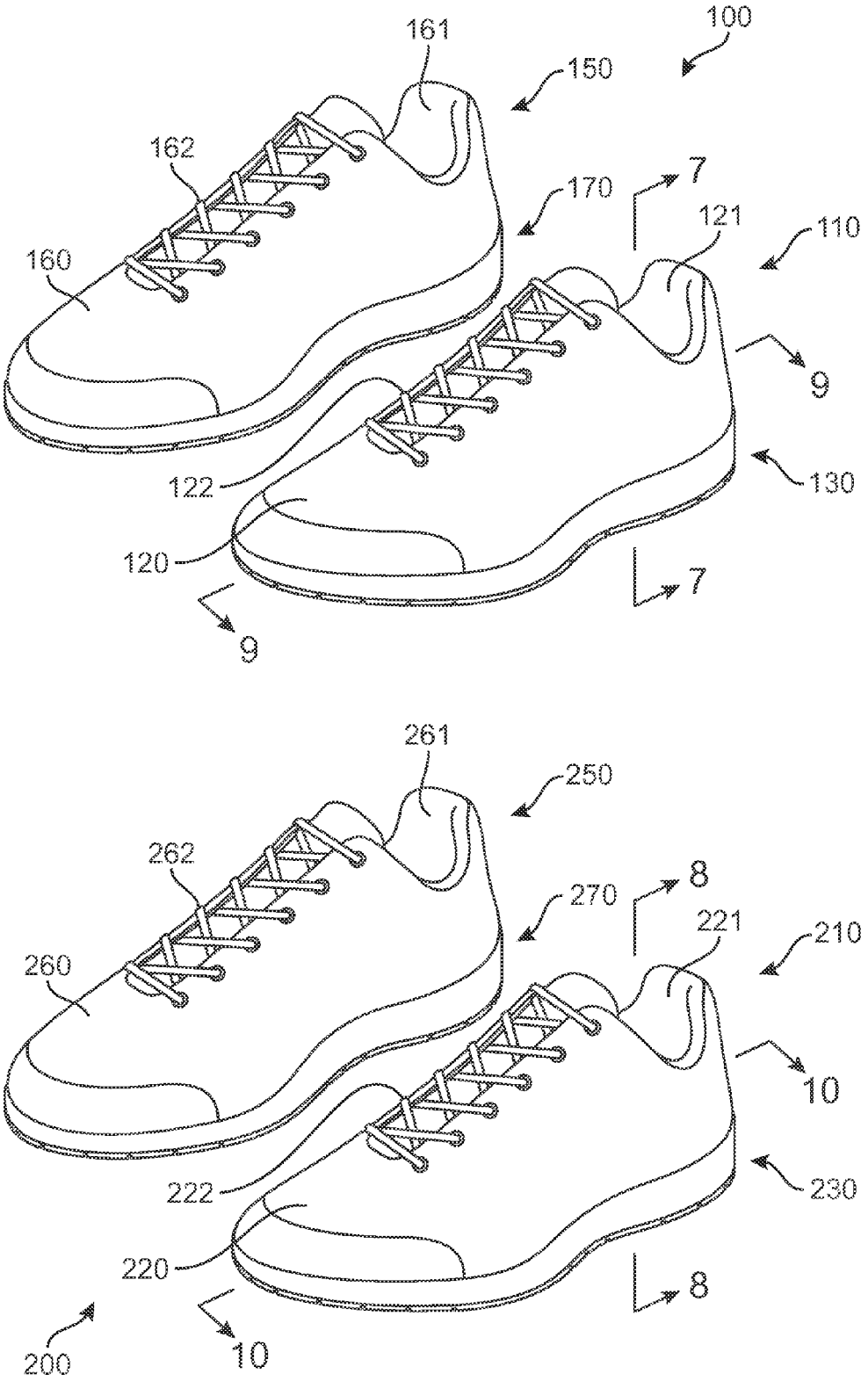
FIG. 1 is an isometric view of an embodiment of a first pair having a first article and a first complementary article, and a second pair having a second article and second complementary article.

FIG. 1 illustrates an isometric view of a first pair of articles 100 and a second pair of articles 200. Although the embodiments depict articles configured as athletic articles of footwear, in other embodiments the articles may be configured as various other kinds of footwear including, but not limited to: hiking boots, soccer shoes, football shoes, sneakers, running shoes, cross-training shoes, rugby shoes, basketball shoes, baseball shoes as well as other kinds of shoes. Moreover, in some embodiments, articles may be configured as various kinds of non-sports related footwear, including, but not limited to: slippers, sandals, high heeled footwear, loafers as well as any other kinds of footwear.

Figure 2:
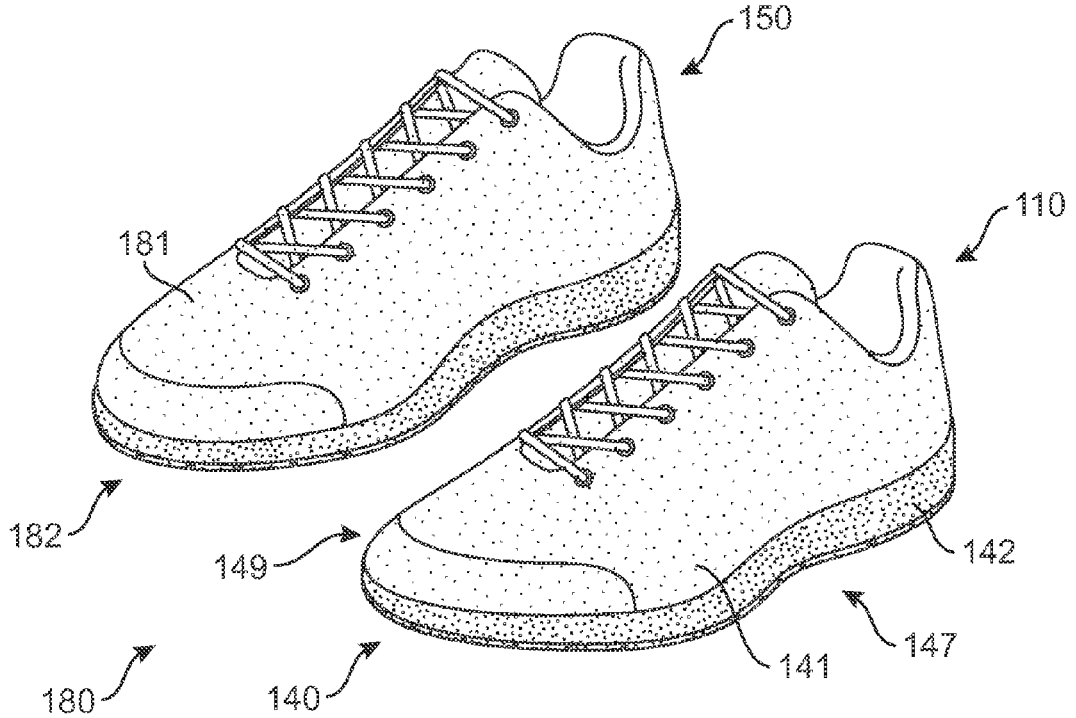
FIG. 2 is an isometric view of an embodiment of a first pair having a first article and a first complementary article, and a second pair having a second article and second complementary article.
Figure 2:
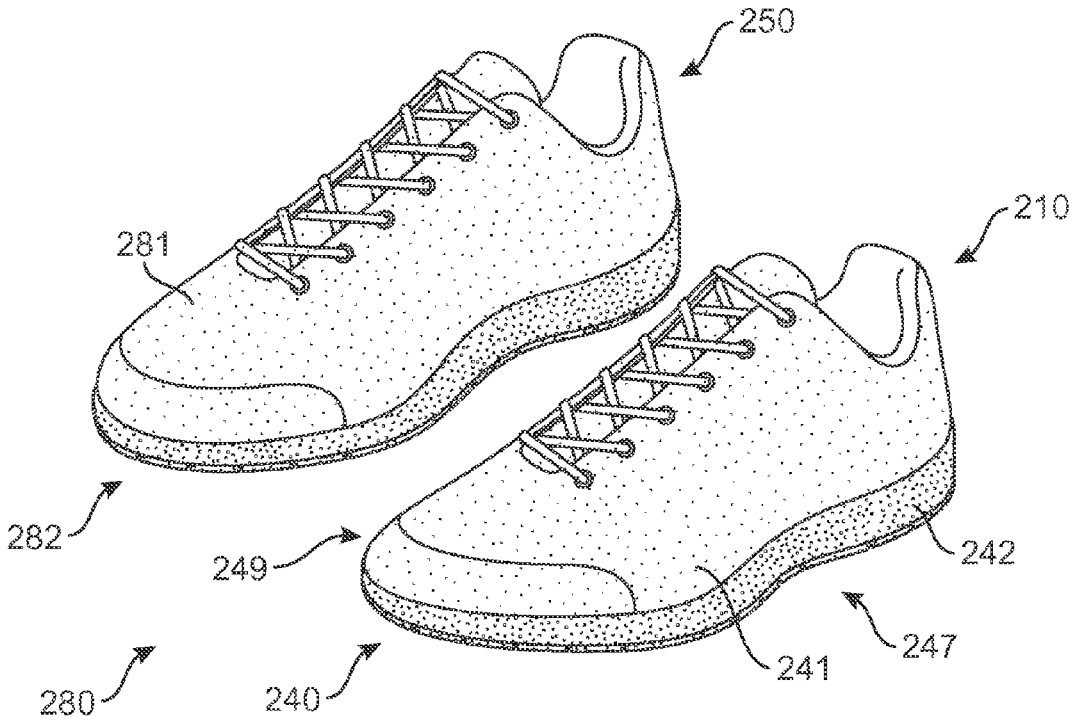

As seen in FIGS. 1-2, first pair of articles 100 comprises a first article 110 and first complementary article 150. First article 110 includes a first upper 120 attached a first sole assembly 130. First upper 120 may be attached to first sole assembly 130 by sewing, adhesively (for example, gluing), cementing, melting, or a combination thereof.

In different embodiments, the materials used to construct an upper can vary. Some embodiments of an upper include leather, synthetic materials (such as plastic or synthetic leather), mesh, or a combination thereon. In FIG. 1, first upper 120 comprises leather and other synthetic materials.

First upper 120 further includes a first opening 121 to receive a foot and a first fastening system 122 that may be used to adjust the size of first opening 121. Some embodiments of a fastening system may include a hook and loop system (for example, Velcro), an elastic member, or a combination thereof. In the embodiment of FIG. 1, first fastening system 122 is comprised of shoe laces passing through apertures of first upper 120.

First complementary article 150 comprises a first complementary upper 160 attached to a first complementary sole assembly 170. First complementary upper 160 may be attached to first sole assembly 170 by sewing, adhesively (for example, gluing), cementing, melting, or a combination thereof. First complementary upper 160 further includes a first complementary opening 161 to receive a foot and a first complementary fastening system 162.

In some embodiments, the materials, designs, logos, color schemes, size, shape, etc., of first complementary article 150 may be substantially similar to first article 110. Of course, in other embodiments first complementary article 150 could differ from first article 110 in at least one of materials, designs, logos, color schemes, size, shape, etc. For example, in some other embodiments, each of first article 110 and first complementary article 150 may be configured with a different graphic or other indicia.

At least one difference between first article 110 and first complementary article 150 is that they are not intended to fit on the same foot of a person. Rather, first article 110 fits on and conforms to one of two feet of a person, and first complementary article 150 fits on the person's remaining foot. For example, first article 110 may be configured to be worn on the left foot of a wearer, while first complementary article 150 may be configured to be worn on the right foot of the wearer.

FIGS. 1-2 further illustrate second pair of articles 200 having second article 210 and second complementary article 250. Second article comprises second upper 220 attached to a second sole assembly 230. Second upper 220 may be attached to second sole assembly 230 by sewing, adhesively (for example, gluing), cementing, melting, or a combination thereof. Second upper 220 further includes second opening 221 to receive a foot and second fastening system 222.

Second complementary article 250 comprises a second complementary upper 260 attached to a second complementary sole assembly 270. Second complementary article 250 may be attached to second complementary sole assembly 270 by sewing, adhesively (for example, gluing), cementing, melting, or a combination thereof. Second complementary upper 260 further includes a second complementary opening 261 to receive a foot and a second complementary fastening system 262. In some embodiments, the materials, designs, logos, color schemes, etc., of second complementary article 250 are substantially similar to second article 210. In other embodiments, second complementary article 250 may differ in at least some aspects from second article 210.

At least one difference between second article 210 and second complementary article 250 is that they are not intended to fit on the same foot of a person. For example, second article 210 may be configured to be worn on the left foot of a wearer, while second complementary article 250 may be configured to be worn on the right foot of the wearer.

For purposes of clarity, the term "appearance" of an article of footwear refers to the visual information about the article of footwear that can be obtained when an observer (such as the wearer or user of the article) looks at the article of footwear. The appearance of the article of footwear may therefore include multiple aspects of the article of footwear that are apparent when viewing the article, including, but not limited to: spatial and/or structural features (such as geometry and/or size), design features (such as colors, logos, and other design elements). In contrast, some features of the article of footwear may not be easily determined by viewing the article, including, for example, the weight and/or the material construction of an article. Furthermore, the term "exterior appearance" for an article of footwear is used throughout this detailed description to refer to the appearance of the exterior portions of the article of footwear. In some cases, the term exterior appearance may be applied separately to different components of an article, such as the upper and/or sole assembly. Moreover, the exterior appearance may exclude the appearance of interior surfaces and/or interior features of the article of footwear, including surfaces that may be in contact with a foot, or sock, when the article of footwear is worn.

In the remainder of this detailed description, the exterior appearance of components, such as the sole assemblies, of two or more articles may be compared. It should therefore be understood by the definition given above that when two components are said to have similar or identical exterior appearances, that this implies the components share similar (or identical) geometries, sizes, designs (e.g., colors, images, logos or other indicia), and surface structures (e.g., trim, areas of mesh, lacing, straps, etc.). Moreover, it may be difficult for a user to distinguish between two components having similar or identical exterior appearances. However, as also discussed below, although two components share a common exterior appearance, they may not be identical in structure, material and/or internal appearance. For example, some pairs of articles may have sole assemblies with similar exterior appearances, but those sole assemblies may have substantially different internal structures.

Figure 3:
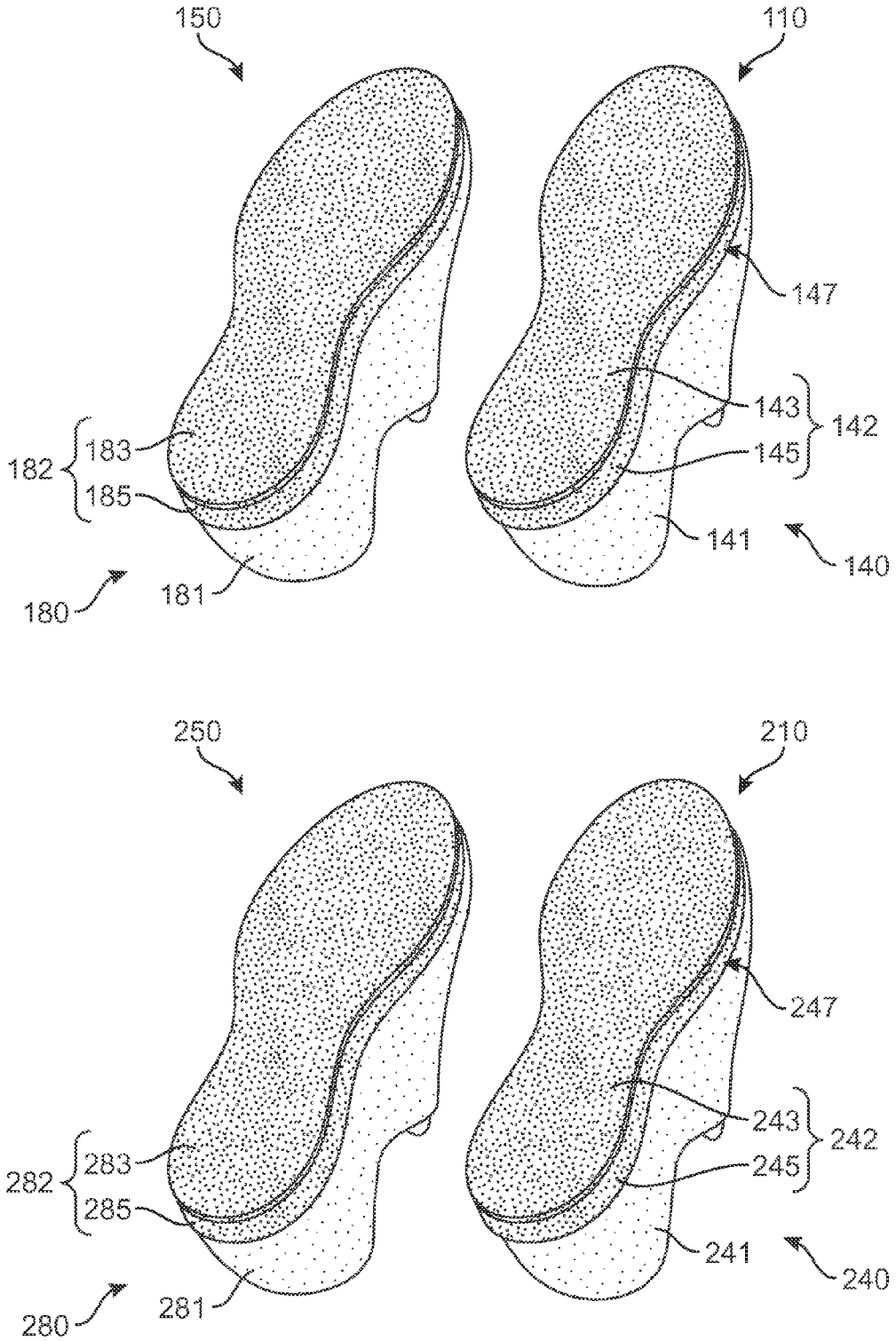
FIG. 3 shows the appearance of an embodiment of the articles of footwear in FIG. 1.

Referring to FIGS. 2-3, first article 110 includes various external portions, such as a first exterior upper portion 141 and first exterior sole assembly portion 142. The first exterior sole assembly portion 142 includes a first exterior sidewall portion 145 and a first exterior outsole portion 143. Likewise, first complementary article 150 includes various external portions, such as first complementary exterior upper portion 181 and first complementary exterior sole assembly portion 182. The first complementary exterior sole assembly portion 182 includes a first complementary exterior sidewall portion 185 and a first complementary exterior outsole portion 183. These exterior portions of both articles may be visible to a wearer or other persons when first pair of articles 100 is worn.

In some embodiments, the exterior appearances of some portions of first article 110 and first complementary article 150 may be similar or even substantially identical. For example, in some embodiments, the exterior appearance of first exterior upper portion 141 and the exterior appearance of first complementary exterior upper portion 181 may be similar or even substantially identical. In other cases, however, the exterior appearances of these exterior upper portions could be different. Such differences could include differences in shape, size, color, design and/or surface textures, for example. In some embodiments, the exterior appearances of first exterior sole assembly portion 142 and first complementary exterior sole assembly portion 182 may also be similar or even substantially identical. However, in other embodiments, the exterior appearances of these exterior sole assembly portions could be substantially different in shape, size, color, design, surface textures and/or other features.

FIGS. 2-3 also illustrate second article 210 having various external portions, such as a second exterior upper portion 241 and second exterior sole assembly portion 242. The second exterior sole assembly portion 242 includes a second exterior sidewall surface 245 and a second exterior outsole portion 243. Likewise, second complementary article 250 includes various external portions, such as second complementary exterior upper portion 281 and second complementary exterior sole assembly portion 282. The second complementary exterior sole assembly portion 282 includes a second complementary exterior sidewall surface 285 and a second complementary exterior outsole portion 283. These exterior portions of both articles may be visible to a wearer or other persons when second pair of articles 200 is worn.

In some embodiments, the exterior appearances of some portions of second article 210 and second complementary article 250 may be similar or even substantially identical. For example, in some embodiments, the exterior appearance of second exterior upper portion 241 and the exterior appearance of second complementary exterior upper portion 281 may be similar or even substantially identical. In other cases, however, the exterior appearances of these exterior upper portions could be different. Such differences could include differences in shape, size, color, design and/or surface textures, for example. In some embodiments, the exterior appearances of second exterior sole assembly portion 242 and second complementary exterior sole assembly portion 282 may also be similar or even substantially identical. However, in other embodiments, the exterior appearances of these exterior sole assembly portions could be substantially different in shape, size, color, design, surface textures and/or other features.

Embodiments may include provisions for allowing a user to select between articles having different performance or utility properties (e.g., cushioning properties, stability properties, etc.), where the articles share a common exterior appearance. As seen in FIG. 1, in at least some embodiments, first pair of articles 100 and second pair of articles 200 may have substantially similar, or even possibly identical, exterior appearances. In some embodiments, for example, first pair of articles 100 and second pair of articles 200 may have uppers with substantially similar exterior appearances. In addition, in some embodiments, first pair of articles 100 and second pair of articles 200 may have sole assemblies with substantially similar exterior appearances. In the exemplary embodiments discussed below and shown in the figures, the articles in first pair of articles 100 and second pair of articles 200 are seen to have similar or substantially identical exterior appearances for their uppers and sole assemblies. However, it should be understood that in other embodiments the upper exterior appearances could be substantially different. For example, in other embodiments, pairs of articles with soles having similar exterior appearances could have uppers that differ in color, trim design and/or material construction.

Referring again to FIG. 2, for purposes of comparison, the exterior appearance of first exterior sole assembly portion 142 is indicated as first sole exterior appearance 147, while the exterior appearance of second exterior sole assembly portion 242 is indicated as second sole exterior appearance 247. For purposes of illustration, first sole exterior appearance 147 and second sole exterior appearance are indicated in FIGS. 2-3 with dark shading. In an exemplary embodiment, first sole exterior appearance 147 and second sole exterior appearance 247 may be similar or even substantially identical. In other words, first sole assembly 130 and second sole assembly 230 look similar or even substantially identical when viewed from the exteriors of first article 110 and second article 210, respectively. Thus, a person observing first article 110 and second article 210 may be led to conclude that the soles of these articles are similar or perhaps even identical.

In some, but not all, embodiments, the uppers of first pair of articles 100 and second pair of articles 200 may also have similar exterior appearances. In some embodiments, the exterior appearance of first exterior upper portion 141 is indicated as first upper exterior appearance 149, while the exterior appearance of second exterior upper portion 241 is indicated as second upper exterior appearance 249. For purposes of illustration, first upper exterior appearance 149 and second upper exterior appearance 249 are indicated in FIGS. 2-3 with light shading. In an exemplary embodiment, first upper exterior appearance 149 and second upper exterior appearance 249 may be similar or even substantially identical. In other words, first upper 120 and second upper 220 look similar or even substantially identical when viewed from the exteriors of first article 110 and second article 210, respectively. Thus, a person observing first article 110 and second article 210 may be led to conclude that the uppers of these articles are similar or perhaps even identical.

The first upper exterior appearance 149 and first sole exterior appearance 147 of first article 110 may collectively comprise a first exterior appearance 140 for first article 110. In other words, first exterior appearance 140 is associated with the visible portions of the entirety of first article 110. Likewise, the second upper exterior appearance 249 and the second sole exterior appearance 247 of second article 210 may collectively comprise a second exterior appearance 240 for second article 210. In other words, second exterior appearance 240 is associated with the visible portions of the entirety of second article 210. Moreover, in the exemplary embodiment, first exterior appearance 140 and second exterior appearance 240 may be similar or even substantially identical.

In a similar manner, first complementary article 150 may have a first complementary exterior appearance 180 and second complementary article 250 may have a second complementary exterior appearance 280. In the exemplary embodiment, first complementary exterior appearance 180 and second complementary exterior appearance 280 may be similar or even substantially identical.

Although the articles discussed and shown in FIG. 1 may have substantially similar exterior appearances, the internal structure of different articles could vary in at least some embodiments. Specifically, as discussed below, in at least some embodiments, two articles with substantially identical exterior appearances could have sole assemblies that differ in structure and/or material construction.

Figure 4:
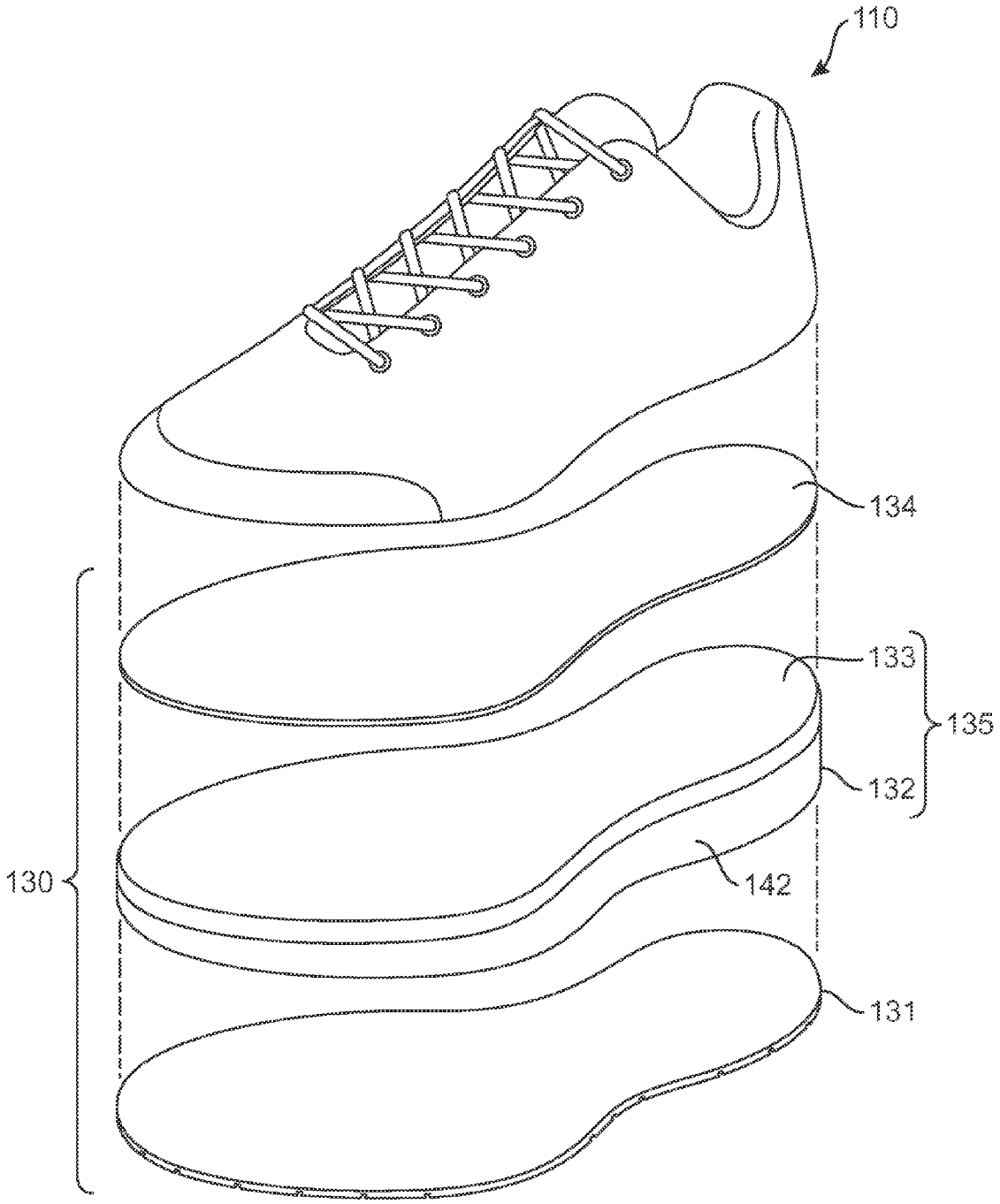
FIG. 4 is an exploded view of an embodiment the first article of footwear, showing the various portions of a first sole assembly.
Figure 5:
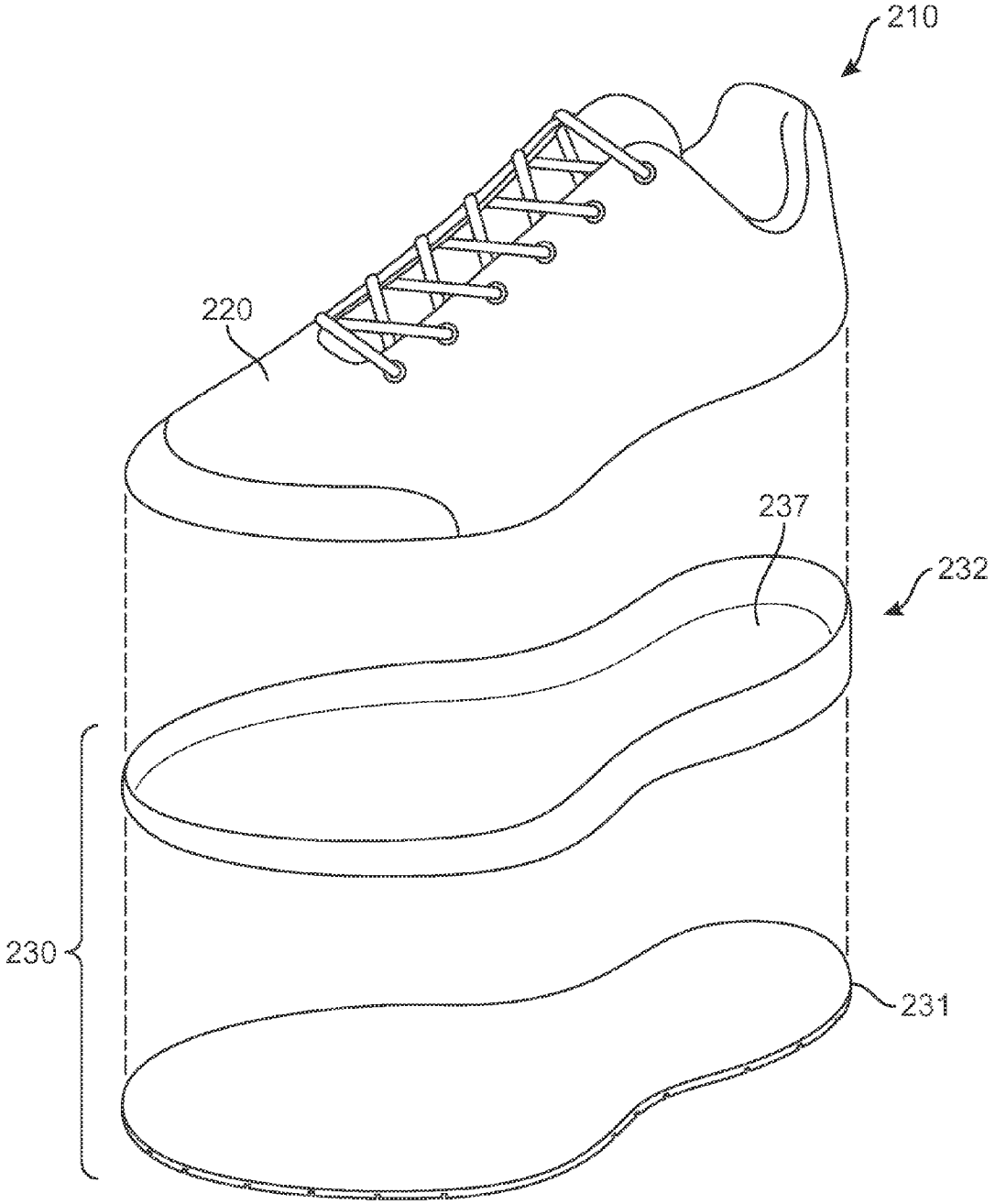
FIG. 5 is an exploded view of an embodiment a second article of footwear, showing the various portions of a second sole assembly.

FIGS. 4-5 illustrate exploded views of an embodiment of a sole assembly of an article. A sole assembly may include several layered portions, including an outsole, an insole and a midsole. Some embodiments of an outsole comprise rubber, plastic, metal, or a combination thereof. In other embodiments, outsole surfaces comprise extrusions (cleats, for examples). Still, in other embodiments, outsole surfaces comprise inner threads for use with threaded extensions (for example, cleats). Some embodiments of outsoles, midsoles, and insoles may comprise rubber, foam rubber, woven fabric, or a combination thereof intended to support the foot. In some embodiments, layered portions of a sole assembly are connected or attached adhesively (for example, gluing), cementing, melting, or a combination thereof.

FIG. 4 illustrates an exploded view of an embodiment of a first sole assembly 130 of first article 110. First sole assembly 130 may include several layered portions, such as first outsole 131, first midsole 135, and first insole 134. As seen in FIG. 4, in some embodiments, first midsole 135 may be further comprised of a first midsole layer 132 and a second midsole layer 133. In some embodiments, first midsole layer 132 and second midsole layer 133 may comprise different materials with different material characteristics such as cushioning and/or support. Of course, in other embodiments, a midsole comprised of a single monolithic portion of material could also be used.

Figure 6:
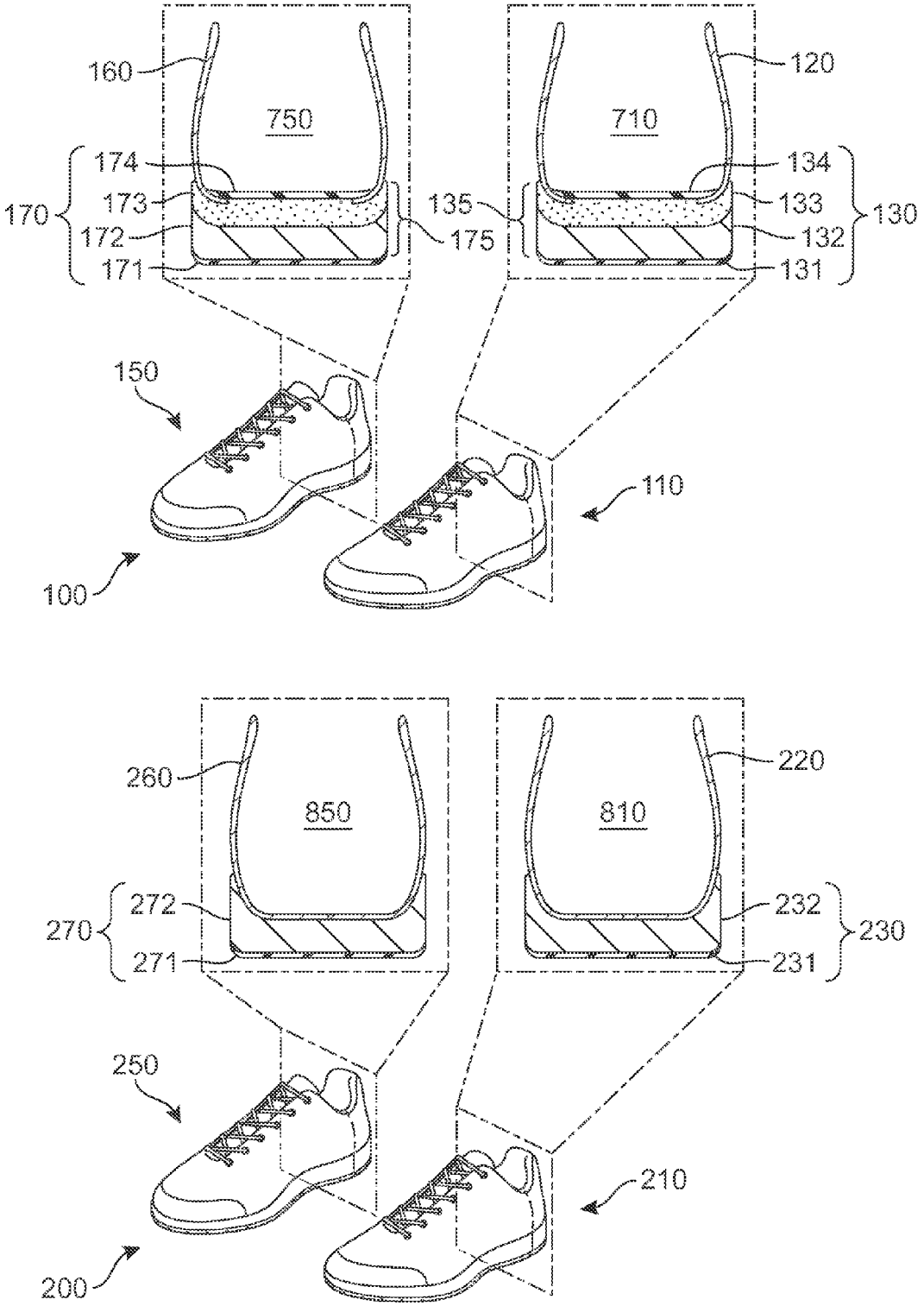
FIG. 6 is an isometric view of an embodiment of the articles of footwear in FIG. 1, with an additional cross sectional view of the articles of footwear.

First complementary article 150 comprises first complementary sole assembly 170 (shown in FIG. 6). First complementary sole assembly 170 may also have several layered portions, including first complementary outsole 171, first complementary midsole 175, and first complementary insole 174. As seen in FIG. 6, in some embodiments, first complementary midsole 175 may be further comprised of a first midsole layer 172 and a second midsole layer 173. First complementary sole assembly 170 is substantially similar, if not identical, to first sole assembly 130 in terms of the order and number of layers, materials, designs, logos, color schemes, size, etc. One difference is that first sole assembly 130 and first complementary sole assembly 170 are not intended to fit the same foot one a person. For example, if first sole assembly 130 is designed and intended to support a person's left foot, then first complementary sole assembly 170 is designed and intended to support the person's right foot.

Several layers of first sole assembly 130 are "destructibly removable." In some embodiments, the entirety of first sole assembly 130 may be destructibly removable. In such embodiments, first article 110 is destroyed, and cannot function properly as an article of footwear, if any of first outsole 131, first midsole 135, or first insole 134 is removed from first article 110. In a similar manner, layers (first complementary outsole 171, first complementary midsole 175, or first complementary insole 174) of first complementary sole assembly 170 may also be destructibly removable.

In other embodiments, first outsole 131 and first midsole 135 may be destructibly removable, while first insole 134 may not be destructibly removable. In such embodiments, first insole 134 may or may not be permanently attached to the top surface of midsole 133. Similarly, in other embodiments, first complementary insole 174 may or may not be destructibly removable.

FIG. 5 illustrates an exploded view of an embodiment of a second sole assembly 230 of second article 210. Second sole assembly 230 has a fixed sole structure 232 attached to the top surface of second outsole 231. Fixed sole structure 232 may generally be fixed in place with respect to second upper 220. In an exemplary embodiment, fixed sole structure 232 may be destructibly removable, such that fixed sole structure 232 cannot be removed from second article 210 without destroying second article 210.

In different embodiments, the structural properties and/or material construction of fixed sole structure 232 can vary. In some embodiments, fixed sole structure 232 may have structural properties common to midsoles. In other embodiments, fixed sole structure 232 may have structural properties common to outsoles. Moreover, in some embodiments, fixed sole structure 232 can have structural properties of both midsoles and outsoles. Thus, fixed sole structure 232 may be configured to provide support, cushioning, energy return as well as other properties. In order to achieve the desired structural properties, fixed sole structure 232 may be made of any materials known in the art for making sole structures, including materials used for midsoles and outsoles. In an exemplary embodiment, fixed sole structure 232 is made of a foam material that enhances cushioning and support.

In some embodiments, second upper 220 terminates near the point of contact with fixed sole structure 232. In other embodiments, such as shown in FIG. 6, second upper 220 is continuous throughout the top surface of fixed sole structure 232. In other embodiments, a layer of fabric may attach to the top surface of fixed sole structure 232.

Although not shown in FIG. 5, second sole assembly 230 may further include a removable sole unit. In particular, in some embodiments, fixed sole structure 232 may be configured to receive a removable sole unit that provides additional support, cushioning and/or other performance enhancing features. In order to better characterize the distinctions between first sole assembly 130 and second sole assembly 230, FIGS. 1-10 illustrate a first configuration of second article 210 in which no removable sole unit is present. Details of various removable sole units that may be used with second sole assembly 230 are discussed below and shown in FIGS. 11-18. Moreover, a second configuration of second article 210, in which a removable sole unit is inserted within second article 210, is discussed below and shown specifically in FIGS. 15-18.

In some embodiments, fixed sole structure 232 may include provisions for receiving a removable sole unit. In an exemplary embodiment, fixed sole structure 232 may be configured with a grooved portion 237. Grooved portion 237 may comprise a hollowed out groove, or recessed portion, within the portion of fixed sole structure 232 that is closest to second upper 220. As discussed in further detail below, grooved portion 237 may be sized and shaped to precisely fit a removable sole unit, which may be inserted into second article 210 in order to enhance support, cushioning, energy return and or other features of second article 210.

Second complementary article 250 comprises second complementary sole assembly 270 (as seen in FIG. 6, discussed later). Second complementary sole assembly 270 includes second complementary outsole surface 271, and second complementary fixed sole structure 272. In some embodiments (not shown), second fixed sole structure 272 may include second complementary midsole 273.

Second complementary sole assembly 270 is substantially similar, if not identical, to second sole assembly 230 in terms of outsole, materials, designs, logos, color schemes, size, etc. One difference is that second sole assembly 230 and second complementary sole assembly 270 are not intended to fit the same foot one a person. For example, if second sole assembly 230 is designed and intended to support a person's left foot, then second complementary sole assembly 270 is designed and intended to support the person's right foot.

FIG. 6 illustrates first pair of articles 100 and second pair of articles 200, as shown in FIG. 1, with an additional cross sectional view in a rear portion of first article 110, first complementary article 150, second article 210, and second complementary article 250. As clearly shown in FIG. 6, although the articles have substantially similar exterior appearances, the internal structure of their corresponding sole assemblies may differ. For example, FIG. 6 clearly shows how the interior volumes of first internal cavity 710 and first complementarity internal cavity 750 may be substantially smaller than the interior volumes of second internal cavity 810 and second complementary internal cavity 850, respectively. It should be understood that second article 210 and second complementary article 250 are shown in a first configuration where the corresponding removable sole units have been removed.

Figure 8:
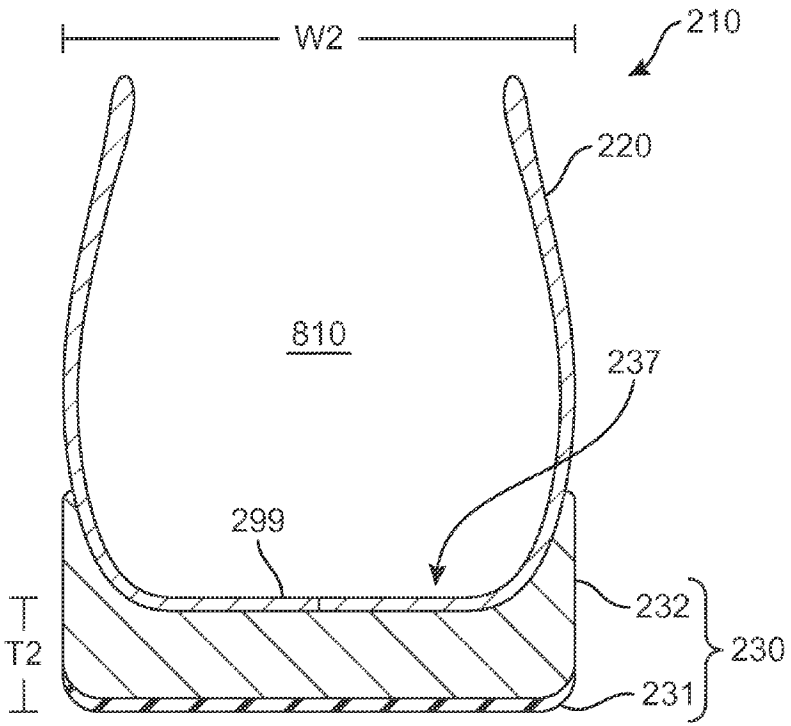
FIGS. 7-8 are cross sectional views in the rear portion of an embodiment of internal cavities of a first article of footwear and a second article of footwear.
Figure 7:
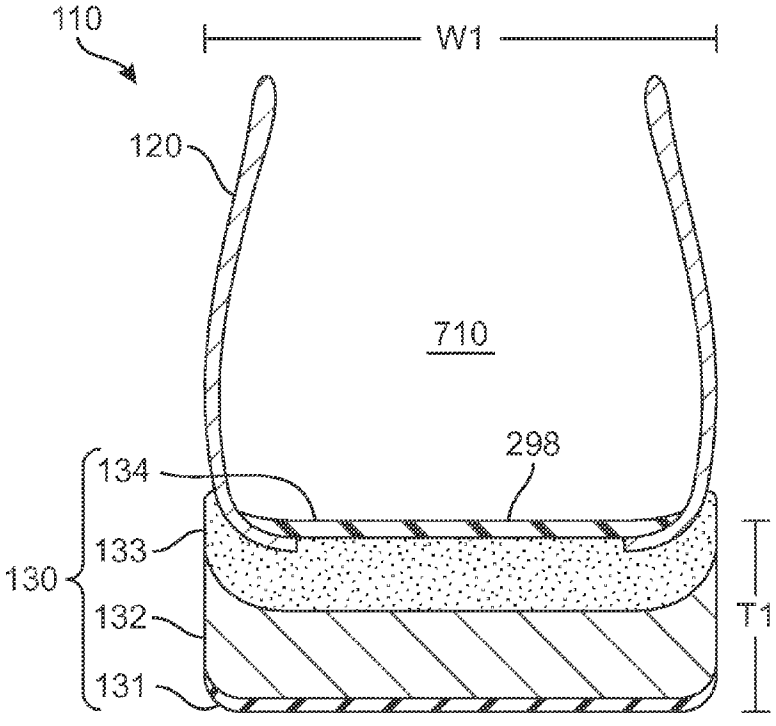
Figure 9:
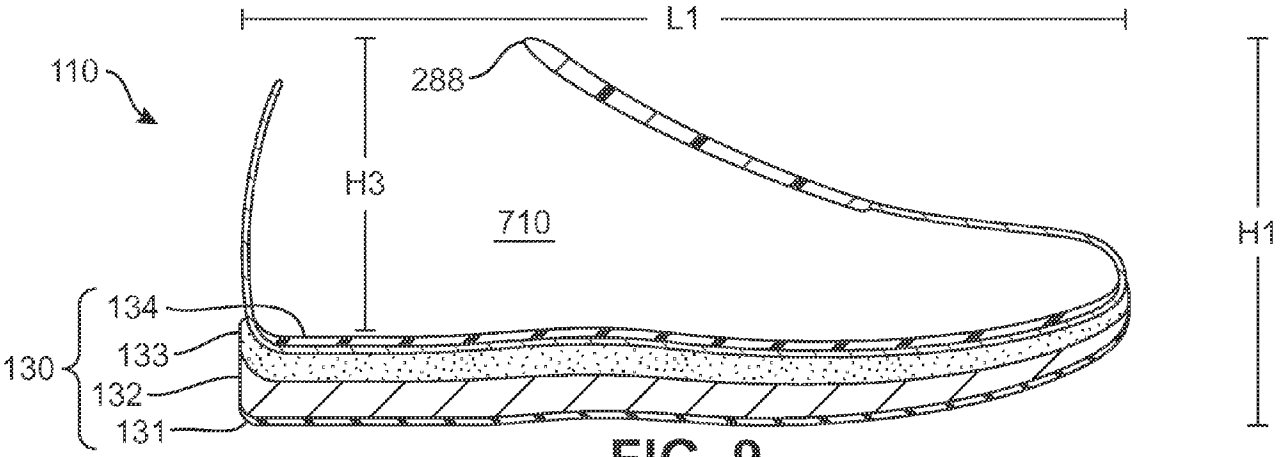
FIGS. 9-10 are lengthwise cross sectional views of an embodiment of internal cavities of a first article of footwear and a second article of footwear.
Figure 10:
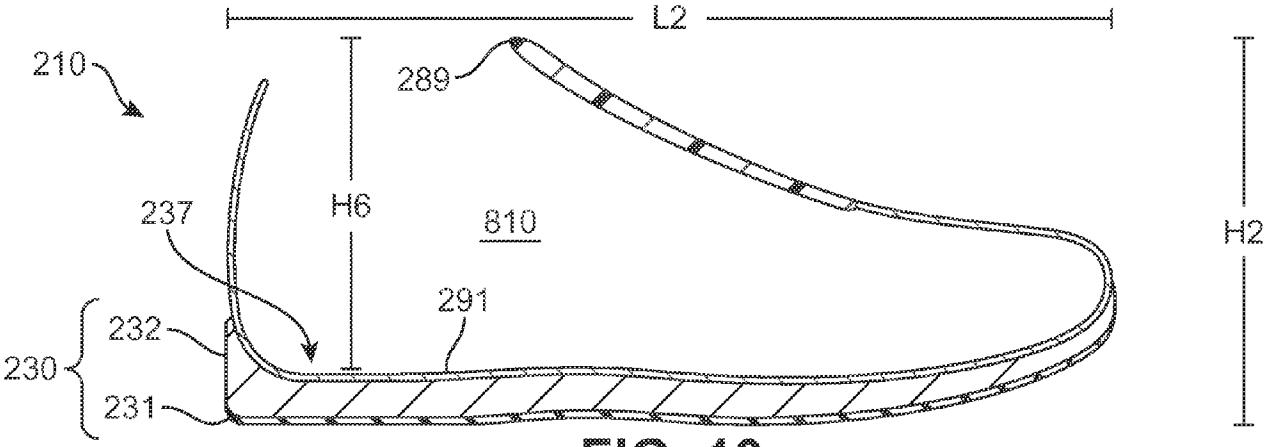

FIGS. 7-8 illustrate rear cross sectional views (similar to FIG. 6) of first article 110 and second article 210, for purposes of further comparing the internal structure of these articles. FIGS. 9-10 illustrate lengthwise cross sectional views first article 110 and second article 210.

Referring to FIGS. 7-10, it should be understood that in this case, first article 110 and second article 210 are designed to fit not only the same foot (for example, a person's left foot) but also the same size foot. Specifically, first article 110 and second article 210 may be configured with substantially similar footwear sizes. Thus, the outer dimensions of these articles may be similar. For example, first article 110 has a width W1 and a length L1 (see FIGS. 7-8), while second article 210 has a width W2 and a length L2 (see FIGS. 9-10). In this exemplary embodiment, width W1 is substantially identical to width W2, while length L1 is substantially identical to length L2. Additionally, first article 110 has an approximate height H1, while second article 210 has an approximate height H2 (see FIGS. 9-10). In an exemplary embodiment, height H1 and height H2 may be substantially similar.

Although first sole assembly 130 and second sole assembly 170 may have similar widthwise and lengthwise dimensions, they may have different thicknesses when second sole assembly 170 is configured without a removable sole unit. In particular, first sole assembly 130 may be thicker than first fixed sole structure 232 when second article 110 is in the first configuration (without a removable sole unit). In the exemplary embodiment, first sole assembly 130, which comprises various components that are all fixed in place with respect to first upper 120, has an approximate thickness T1 at a central region 298 of first sole structure 130. In the exemplary embodiment fixed sole structure 232, which is the only part of second sole assembly 230 that is fixed in place with respect to second upper 220, has an approximate thickness T2 at a central region 299 of second sole structure 230. As clearly seen by comparing FIGS. 7-8, in the exemplary embodiment thickness T1 is substantially greater than thickness T2. Correspondingly, as shown in FIGS. 9-10, this increased thickness for first sole assembly 130 results in a decreased internal height H3 for first internal cavity 710, when compared to the internal height H6 of second internal cavity 810. Here, internal height H3 of first internal cavity 710 is measured between upper periphery 288 of first upper 120 and first insole 134, while internal height H6 of second internal cavity 810 is measured between upper periphery 289 of second upper 220 and a bottom most portion 291 of second internal cavity 810. This arrangement results in the increased interior volume and cross sectional area for second interior cavity 810 as compared to the interior volume of first interior cavity 710.

As previously discussed, second pair of articles 200 may be configured to receive one or more removable sole units. The term "removable sole unit" as used throughout this detailed description and in the claims refers to a portion of a sole assembly that can be inserted into, and removed from, a fixed sole structure without damaging either the removable sole unit or the fixed sole structure. A removable sole unit may incorporate a midsole, an insole and/or a combination of a midsole and an insole. In particular, a removable sole unit could be configured with performance properties and/or structural features typically associated with a midsole and/or with an insole.

Figure 11:
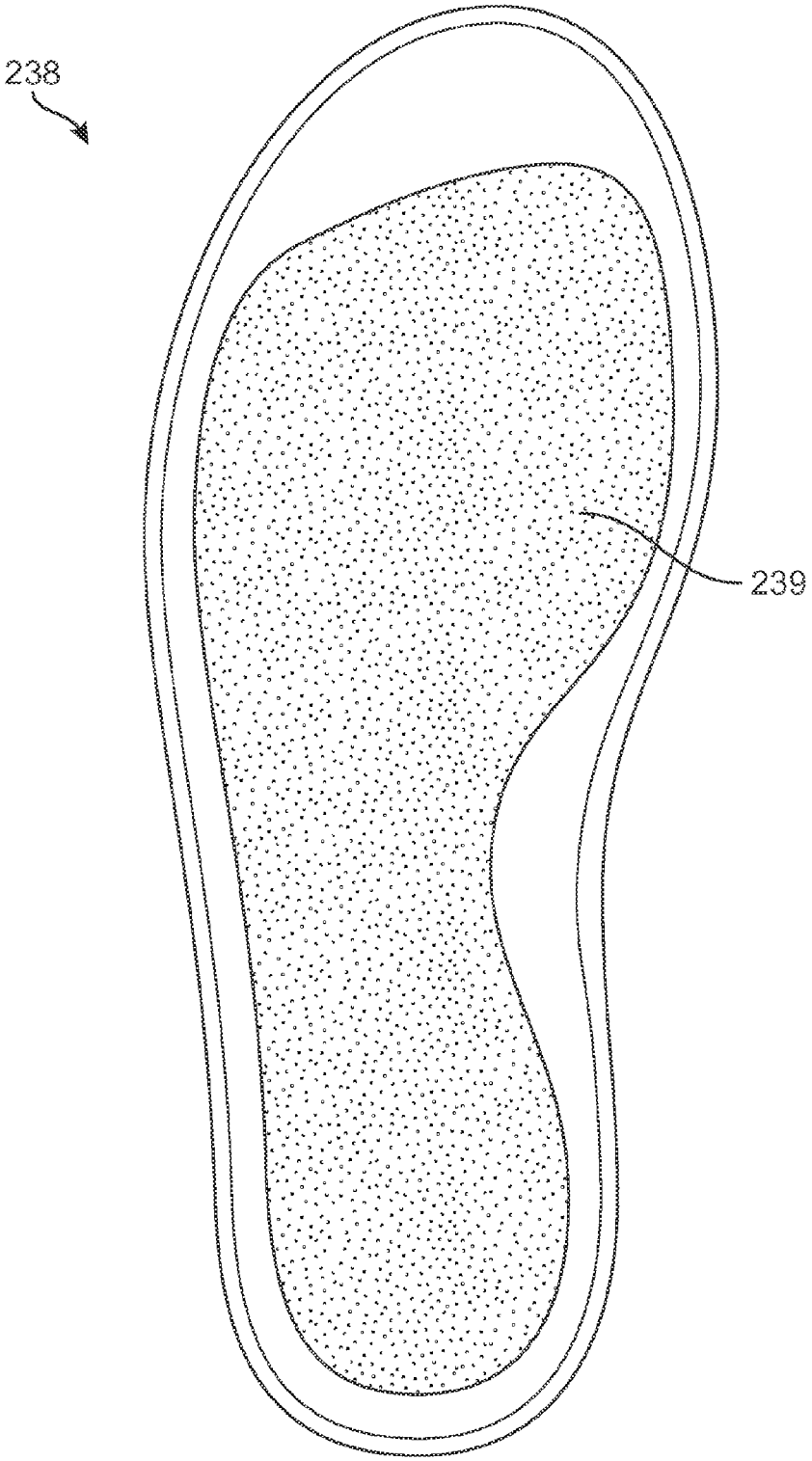
FIG. 11 is a top view of an embodiment of a removable sole unit.
Figure 12:
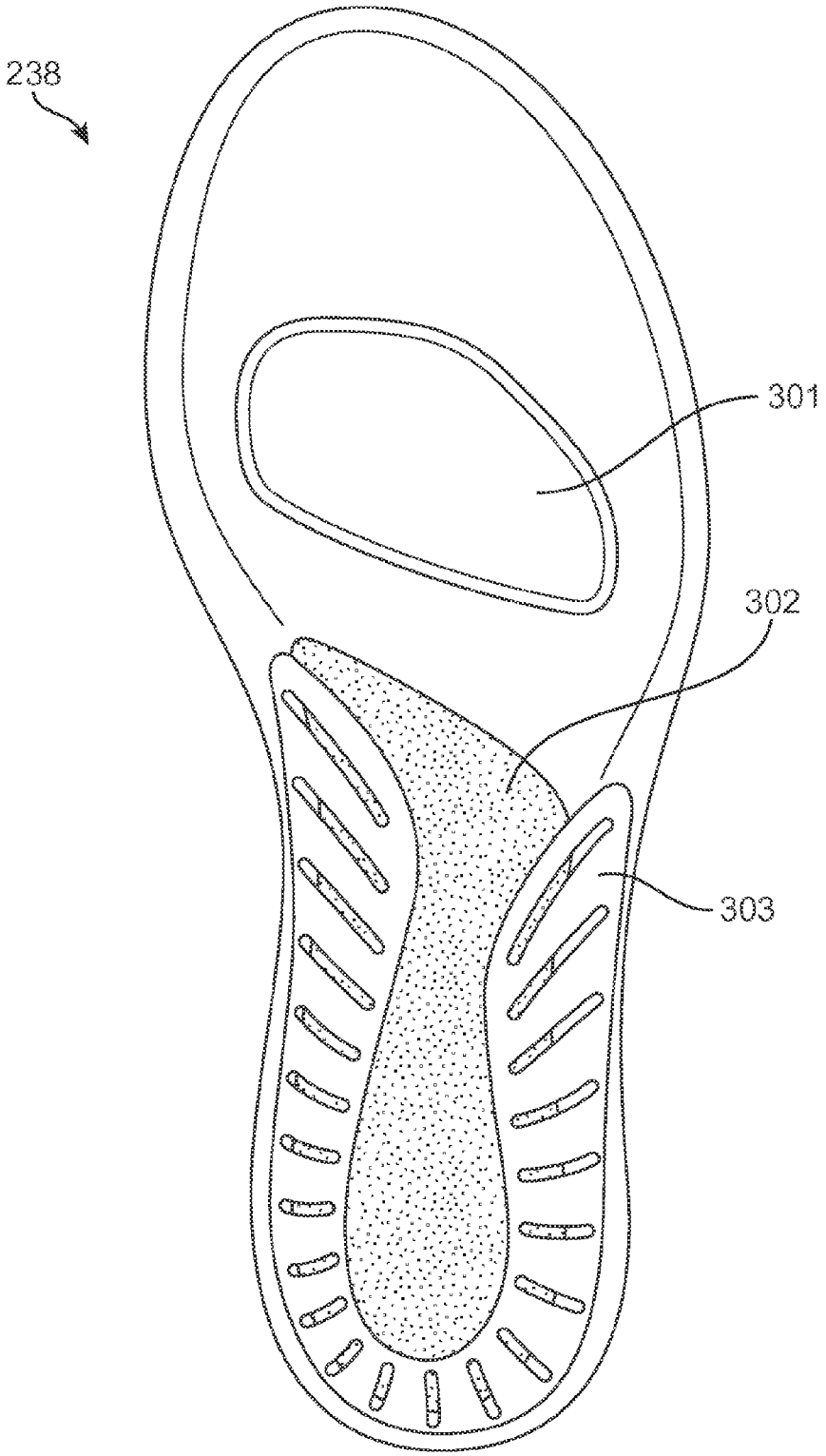
FIG. 12 is a bottom view of the embodiment of the removable sole unit in FIG. 11.
Figure 13:
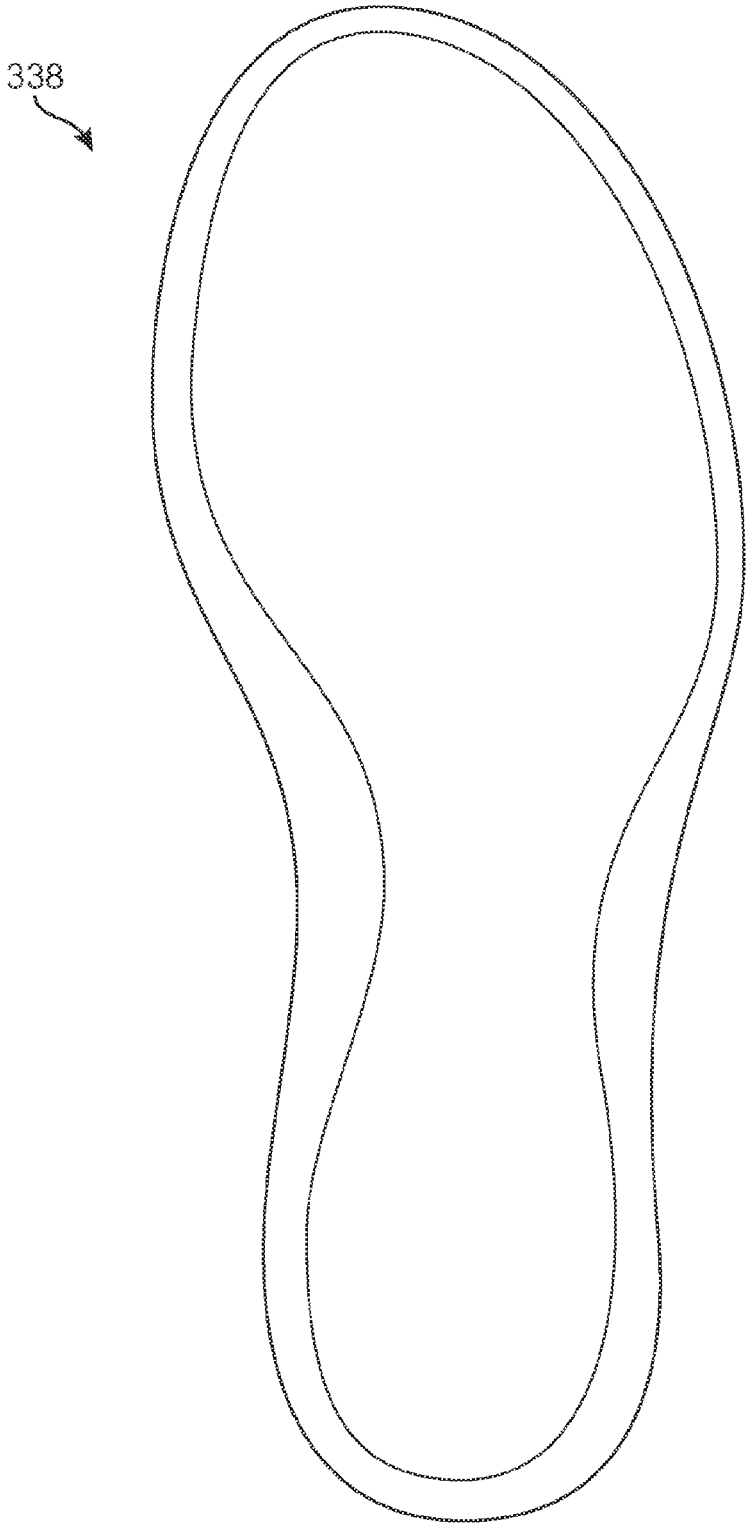
FIG. 13 is a bottom view of another embodiment of a removable sole unit.

FIGS. 11-13 illustrate an embodiment of a removable sole unit 238. In some embodiments, removable sole unit comprises foam rubber, fabric layer, plastic, or other materials intended to provide cushion and support. A complementary removable sole unit (not shown) is substantially similar to removable sole unit 238 in materials, design, size, color scheme, etc. One difference is that removable sole unit 238 and the complementary removable sole unit are not intended to fit the same foot one a person. For example, if removable sole unit 238 is designed and intended to support a person's left foot, then the complementary removable sole unit is designed and intended to support the person's right foot.

FIG. 11 illustrates a top view of a removable sole unit 238. Removable sole unit comprises foam rubber with a fabric layer 239 on the top surface of the foam robber. In some cases, fabric layer 239 may allow for improved comfort and/or traction between a foot (or sock) and the top of removable sole unit 239. FIG. 12 is a bottom view of removable sole unit 238. Additional cushioning element 301 near the "ball" of a foot in a recess of removable sole unit 238 provides a soft cushion for the front portion of a foot. A soft plastic layer 302 provides a more sturdy support to removable sole unit 238. A rigid plastic layer 303 provides a further support region to the foot.

Removable sole unit 238 is configured to fit firmly in grooved portion 237 of second article 210. When inserted into grooved portion 237, removable sole unit 238 is intended to provide various levels of support to a person's foot, depending on the embodiment of removable sole unit 238 chosen. Similarly, a complementary removable sole unit (not shown) is configured to fit firmly in a grooved portion (not shown) of second complementary article 250.

FIG. 13 illustrates is a bottom view of another embodiment of a removable sole unit 338. The embodiment shown in FIG. 11 comprises a foam rubber material throughout. However, the top view (not shown) has a similar design and similar fabric layer as shown in FIG. 11.

In some embodiments, the differences in structure and/or material characteristics of the sole units described above may impart different performance characteristics to second article 210, when assembled with fixed sole structure 232. For example, the embodiment shown in FIGS. 11-12, having additional support elements, may assist a runner with a pronation issues (for example, overpronation or underpronation). The embodiment shown in FIG. 13, comprising a consistent material throughout, may offer a basic cushion for a person who enjoys walking.

Figure 14:
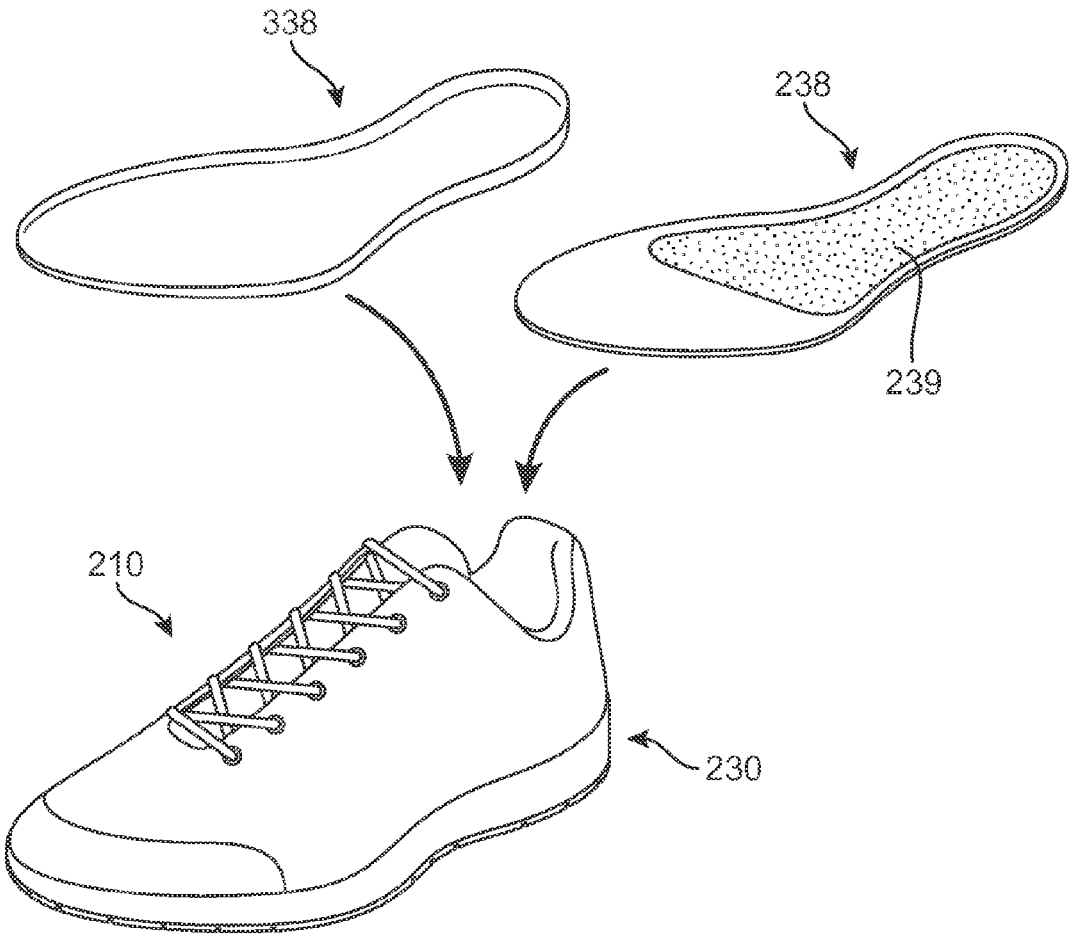
FIG. 14 is an isometric view of an embodiment of a second article of footwear, and the embodiments of removable sole units in FIGS. 11-13.

FIG. 14 is an isometric view of second article 210, removable sole unit 238, and removable sole unit 338. Grooved portion 237 (see FIG. 5) of second sole assembly 230 is operable to receive various embodiments of removable sole units. However, in some embodiments, a removable sole unit is made specifically for a specific size of second article. For example, a second article made to fit a "size 9" foot requires a removable sole unit that is also made to fit the size 9 foot. In other words, a removable sole unit should fit in and conform to the dimensions of grooved portion such that no alterations to the removable sole unit are required. For clarity, a grooved portion (such as grooved portion 237) is operable to receive just one removable sole unit at a time. Thus, removable sole unit 238 and removable sole unit 338 provide a pair of interchangeable inserts.

FIGS. 15-18 illustrate cross sections of first article 110 and second article 210, and a removable sole unit 238 inserted into grooved portion 237 of second sole assembly 230.

Figure 16:
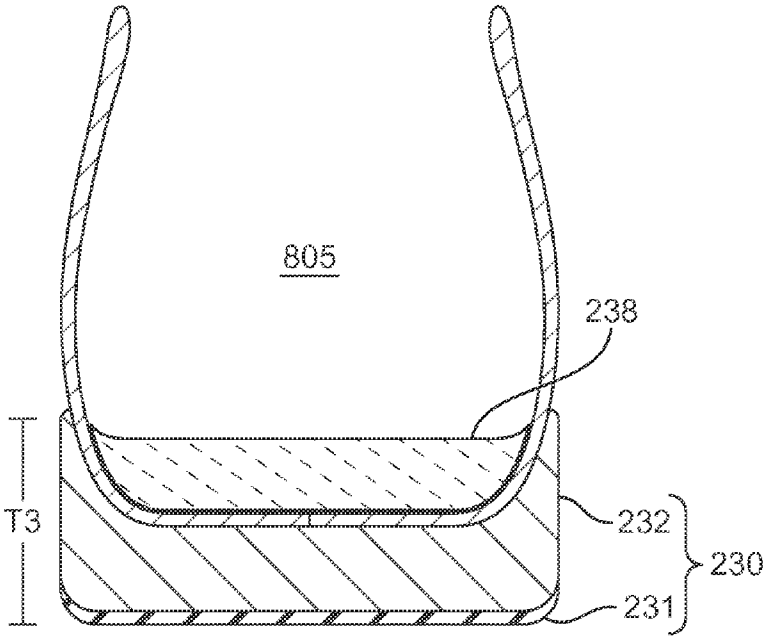
FIGS. 15-16 are cross sectional views in the rear portion of an embodiment of internal cavities of a first article of footwear and a second article of footwear, the second article of footwear having an embodiment of a removable sole unit inserted into the second article of footwear.
Figure 18:
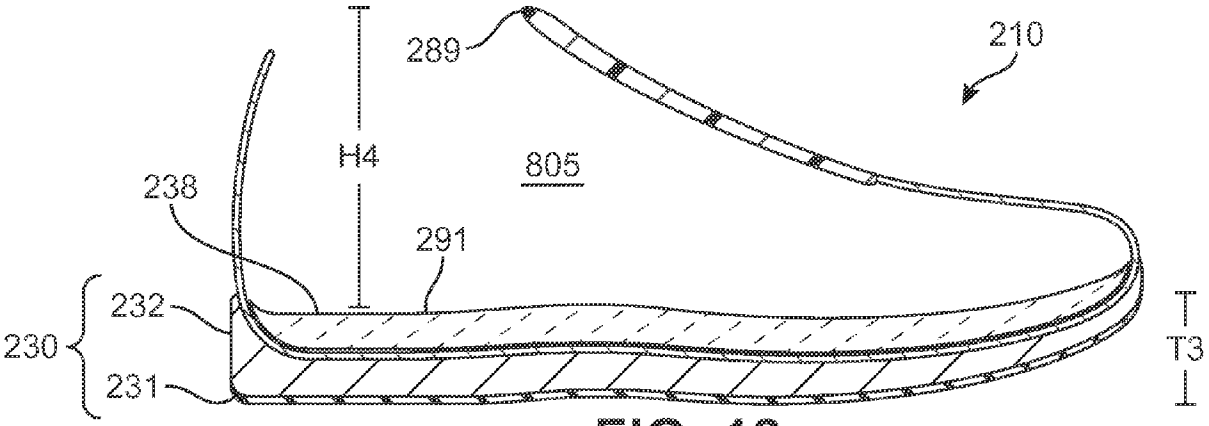

As seen by comparing FIGS. 16 and 18 with FIGS. 8 and 10, the interior dimensions of second article 210 are changed between the first configuration without a removable sole unit (FIGS. 8 and 10) and the second configuration with removable sole unit 238 inserted (FIGS. 16 and 18). Specifically, with removable sole unit 238 in place, second article 210 now has a reduced second internal cavity 805. This reduced second internal cavity 805 has a smaller interior volume and smaller cross sectional area from second internal cavity 810. In other words, the interior volume and cross sectional area of the internal cavity of second article 210 are decreased when a removable sole unit is added. Furthermore, it is clear from the figures that the interior volumes and cross sectional areas of first article 110 and second article 210 are more similar when second article 210 is in the second configuration (i.e., with removable sole unit 238 inserted) than when second article 210 is in the first configuration (i.e., without a removable sole unit inside second article 210). In a similar manner, the interior volume of second complementary article 250 may also be reduced when a complementary removable sole unit is inserted into second complementary article 250.

Figure 15:
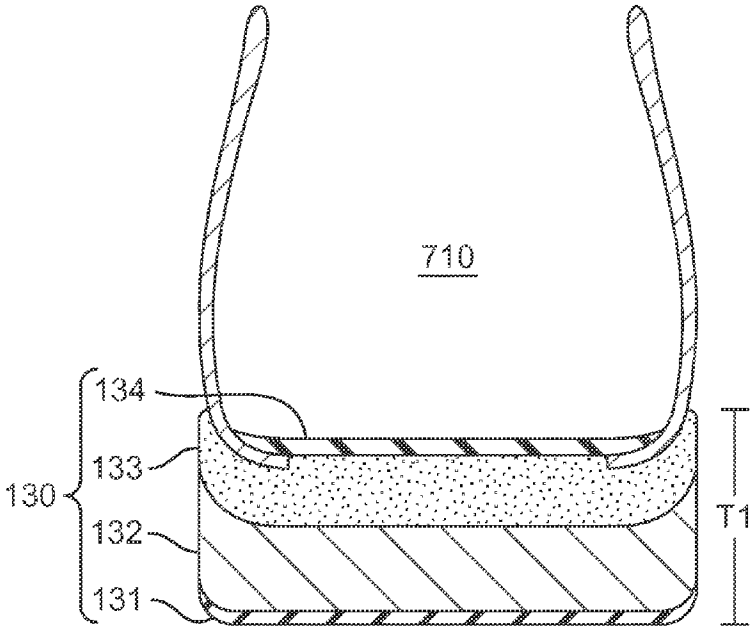
Figure 17:
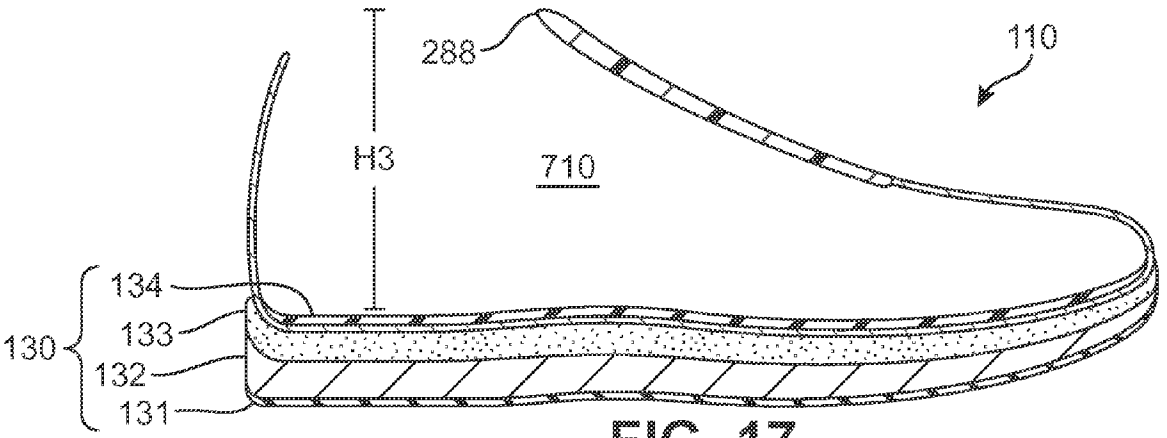
FIG. 17-18 are lengthwise cross sectional views of an embodiment of internal cavities of a first article of footwear and a second article of footwear, the second article of footwear having an embodiment of a removable sole unit inserted into the second article of footwear.

Referring to FIGS. 15-16, with removable sole unit 238 inserted into grooved portion 237 of second sole assembly 230, the thickness of second sole assembly 230 is increased from second sole thickness T2 (shown in FIG. 8) to third sole thickness T3 (shown in FIG. 16). Moreover, the thickness of second sole assembly 230 is more similar to the thickness of first sole assembly 130 when second article 210 is in the second configuration than when second article 210 is in the first configuration. Furthermore, as seen in FIGS. 17-18, the interior height H4 of reduced second interior cavity 805 is increased between the first and second configurations of second article 210.

Although the current embodiments illustrate a first article 110 and second article 210 wherein the second article 210 is configured to receive one of several removable sole units 238, other embodiments could incorporate a different number of removable sole units. For example, other embodiments could include three, four or even more different removable sole units for use with a single article of footwear.

It is contemplated that articles with removable sole units could be sold with or without one or more removable sole units. In some embodiments, two or more removable sole units could be sold with an article as a kit of parts, for example in a single container or packaging. In other embodiments, one or more removable sole units could be purchased separately from the article.

The description provided above is intended to illustrate some possible combinations of various features associated with an interchangeable insert system. Those skilled in the art will understand, however, that within each embodiment, some features may be optional. Moreover, different features discussed in different embodiments could be combined in still other embodiments and would still fall within the scope of the attached claims. Some features could be used independently in some embodiments, while still other features could be combined in various different ways in still other embodiments.

While various embodiments have been described, the description is intended to be exemplary, rather than limiting and it will be apparent to those of ordinary skill in the art that many more embodiments and implementations are possible that are within the scope of the embodiments. Accordingly, the embodiments are not to be restricted except in light of the attached claims and their equivalents. Also, various modifications and changes may be made within the scope of the attached claims.

What is claimed is:

1. A plurality of articles of footwear, comprising:

a first pair of articles of footwear, wherein each article of footwear of the first pair of articles of footwear has a first upper and a first sole assembly including a first sole structure fixed in place with respect to the first upper such that the first sole structure cannot be removed from the respective article of footwear without damaging the same article of footwear and wherein the first sole assembly has a first thickness;

a second pair of articles of footwear, wherein each article of footwear of the second pair of articles of footwear has a second upper and a second sole assembly, the second sole assembly including:

a second sole structure fixed in place with respect to the corresponding second upper such that the second sole structure cannot be removed from the respective article of footwear of the second pair of articles of footwear without damaging the same article of footwear, wherein the second sole structure includes a grooved portion; and a first removable sole unit configured to fit within the groove portion of the second sole structure, wherein each article of footwear of the second pair of articles of footwear has a first configuration in which the first removable sole unit is placed outside of the respective article of footwear, wherein each article of footwear of the second pair of articles of footwear has a second configuration in which the first removable sole unit is placed within the respective article of footwear, wherein the second sole assembly has a second thickness when the respective article of footwear is in the first configuration;

wherein the second sole assembly has a third thickness when the respective article of footwear is in the second configuration;

wherein each article of footwear of the first pair of articles of footwear and each article of footwear of the second pair of articles of footwear have substantially identical footwear sizes;

wherein the first thickness and the third thickness are substantially equal and wherein the third thickness is greater than the second thickness; and wherein the first upper is identical to the second upper.

2. The plurality of articles of footwear according to claim 1, wherein the first sole assembly includes a third sole structure fixed in place with respect to the first sole structure, wherein the third sole structure cannot be removed from the first pair of articles of footwear without damaging the first pair of articles of footwear.

3. The plurality of articles of footwear according to claim 2, wherein the first sole structure is a midsole layer and the third sole structure is a midsole layer.

4. The plurality of articles of footwear according to claim 3, wherein the first sole assembly further includes a first outsole fixed in place with respect to the second sole structure, wherein the first outsole cannot be removed from the first pair of articles of footwear without damaging the first pair of articles of footwear.

5. The plurality of articles of footwear according to claim 4, wherein the second sole assembly further includes a second outsole fixed in place with respect to the second sole structure, wherein the second outsole cannot be removed from the second pair of articles of footwear without damaging the second pair of articles of footwear.

6. The plurality of articles of footwear according to claim 1, wherein the first pair of articles of footwear and the second pair of articles of footwear have substantially identical lengths and wherein the first pair of articles of footwear and the second pair of articles of footwear have substantially identical widths.

7. The plurality of articles of footwear according to claim 1, wherein the second pair of articles of footwear further includes a second removable sole unit configured to fit within the groove portion of the second sole structure of one article of footwear of the second pair of articles of footwear and wherein the second removable sole unit is interchangeable with the first removable sole unit.

8. The plurality of articles of footwear according to claim 7, wherein the second removable sole unit is more supportive than the first removable sole unit.

9. A plurality of articles of footwear, comprising:

a first pair of articles of footwear, wherein each article of footwear of the first pair of articles of footwear has a first upper and a first sole assembly including a first sole structure fixed in place with respect to the first upper such that the first sole structure cannot be removed from the respective article of footwear without damaging the same article of footwear and wherein each article of footwear of the first pair of articles of footwear has a first interior cavity with a first interior volume;

a second pair of articles of footwear, wherein each article of footwear of the second pair of articles of footwear has a second upper and a second sole assembly, the second sole assembly including:

a second sole structure fixed in place with respect to the corresponding second upper such that the second sole structure cannot be removed from the respective article of footwear of the second pair of articles of footwear without damaging the same article of footwear, wherein the second sole structure includes a grooved portion; and a removable sole unit configured to fit within the groove portion of the second sole structure, wherein each article of footwear of the second pair of articles of footwear has a first configuration in which the removable sole unit is placed outside of the respective article of footwear, wherein each article of footwear of the second pair of articles of footwear has a second configuration in which the removable sole unit is placed within the respective article of footwear, wherein each article of footwear of the second pair of articles of footwear has a second internal cavity, wherein the second internal cavity has a second interior volume when the respective article of footwear is in the first configuration and wherein the second internal cavity has a third interior volume when the same article of footwear is in the second configuration;

wherein each article of footwear of the first pair of articles of footwear and each article of footwear of the second pair of articles of footwear have substantially identical footwear sizes; and wherein the first interior volume and the third interior volume are substantially equal and wherein the second interior volume is greater than the first interior volume.

10. The plurality of articles of footwear according to claim 9, wherein the first sole assembly includes a third sole structure fixed in place with respect to the first sole structure, wherein the third sole structure cannot be removed from the first pair of articles of footwear without damaging the first pair of articles of footwear.

11. The plurality of articles of footwear according to claim 10, wherein the first sole structure is a midsole layer and the third sole structure is a midsole layer.

12. The plurality of articles of footwear according to claim 9, wherein the first sole assembly further includes a first outsole fixed in place with respect to the first sole structure, wherein the first outsole cannot be removed from the first pair of articles of footwear without damaging the first pair of articles of footwear.

13. The plurality of articles of footwear according to claim 12, wherein the second sole assembly further includes a second outsole fixed in place with respect to the second sole structure, wherein the second outsole cannot be removed from the second pair of articles of footwear without damaging the second pair of articles of footwear.

14. The plurality articles of footwear according to claim 9, wherein the second pair of articles of footwear further includes a second removable sole unit configured to fit within the groove portion of the second sole structure of one article of footwear of the second pair of articles of footwear and wherein the second removable sole unit is interchangeable with the first removable sole unit.

15. The plurality of articles of footwear according to claim 14, wherein the second removable sole unit is more supportive than the first removable sole unit.

16. A plurality of articles of footwear, comprising:

a first pair of articles of footwear, wherein each article of footwear of the first pair of articles of footwear has a first upper and a first sole assembly including a first sole structure fixed in place with respect to the first upper such that the first sole structure cannot be removed from the respective article of footwear without damaging the same article of footwear and wherein the first sole assembly has a first thickness;

a second pair of articles of footwear, wherein each article of footwear of the second pair of articles of footwear has a second upper and a second sole assembly, the second sole assembly including:

a second sole structure fixed in place with respect to the corresponding second upper such that the second sole structure cannot be removed from the respective article of footwear of the second pair of articles of footwear without damaging the same article of footwear, wherein the second sole structure includes a grooved portion; and a first removable sole unit configured to fit within the groove portion of the second sole structure, a second removable sole unit configured to fit within the groove portion of the second sole structure, wherein the first removable sole unit is interchangeable with the second removable sole unit, wherein each article of footwear of the second pair of articles of footwear has a first configuration in which the first removable sole unit is placed outside of the respective article of footwear, wherein each article of footwear of the second pair of articles of footwear has a second configuration in which the first removable sole unit is placed within the respective article of footwear, wherein the second sole assembly has a second thickness when the respective article of footwear is in the first configuration;

wherein the second sole assembly has a third thickness when the respective article of footwear is in the second configuration;

wherein each article of footwear of the first pair of articles of footwear and each article of footwear of the second pair of articles of footwear have substantially identical footwear sizes; and wherein the first thickness and the third thickness substantially equal and wherein the third thickness is greater than the second thickness.

17. The plurality of articles of footwear according to claim 16, wherein each article of footwear of the second pair of articles of footwear has a third configuration in which the second removable sole unit is placed within the respective article of footwear.

18. The plurality of articles of footwear according to claim 16, wherein the second sole assembly has a second thickness when the respective article of footwear is in the first configuration;

wherein the second sole assembly has a third thickness when the respective article of footwear is in the second configuration;

wherein each article of footwear of the first pair of articles of footwear and each article of footwear of the second pair of articles of footwear have substantially identical footwear sizes; and wherein the first thickness and the third thickness are substantially equal and wherein the third thickness is greater than the second thickness.

19. The plurality of articles of footwear according to claim 18, wherein the second sole assembly has a fourth thickness when the respective article of footwear is in the third configuration; and wherein the first thickness and the fourth thickness substantially equal and wherein the fourth thickness is greater than the second thickness.

20. The plurality of articles of footwear according to claim 19, wherein the fourth thickness is substantially equal to the third thickness.

* * * * *